US007799185B1

(12) United States Patent
Willit

(10) Patent No.: US 7,799,185 B1
(45) Date of Patent: Sep. 21, 2010

(54) POROUS MEMBRANE ELECTROCHEMICAL CELL FOR URANIUM AND TRANSURANIC RECOVERY FROM MOLTEN SALT ELECTROLYTE

(75) Inventor: James L. Willit, Batavia, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 905 days.

(21) Appl. No.: 11/530,573

(22) Filed: Sep. 11, 2006

Related U.S. Application Data

(62) Division of application No. 10/761,916, filed on Jan. 21, 2004, now Pat. No. 7,267,754.

(51) Int. Cl.
*C25C 7/00* (2006.01)
*C25C 7/04* (2006.01)

(52) U.S. Cl. ..... 204/243.1; 204/252

(58) Field of Classification Search ..... 204/243.1, 204/251, 252
See application file for complete search history.

(56) References Cited

U.S. PATENT DOCUMENTS 4,338,177 A * 7/1982 Withers et al. ..... 204/247.3
5,531,868 A * 7/1996 Miller et al. ..... 205/44
5,810,993 A * 9/1998 Keller et al. ..... 205/368

* cited by examiner

*Primary Examiner*—Patrick Ryan
*Assistant Examiner*—William T Leader
(74) *Attorney, Agent, or Firm*—Bradley W. Smith; Daniel D. Park

(57) ABSTRACT

An improved process and device for the recovery of the minor actinides and the transuranic elements (TRU's) from a molten salt electrolyte. The process involves placing the device, an electrically non-conducting barrier between an anode salt and a cathode salt. The porous barrier allows uranium to diffuse between the anode and cathode, yet slows the diffusion of uranium ions so as to cause depletion of uranium ions in the catholyte. This allows for the eventual preferential deposition of transuranics present in spent nuclear fuel such as Np, Pu, Am, Cm. The device also comprises an uranium oxidation anode. The oxidation anode is solid uranium metal in the form of spent nuclear fuel. The spent fuel is placed in a ferric metal anode basket which serves as the electrical lead or contact between the molten electrolyte and the anodic uranium metal.

8 Claims, 8 Drawing Sheets

POROUS MEMBRANE ELECTROCHEMICAL CELL FOR URANIUM AND TRANSURANIC RECOVERY FROM MOLTEN SALT ELECTROLYTE

CROSS REFERENCE TO RELATED APPLICATION

This application is a Division of U.S. application Ser. No. 10/761,916, which was filed Jan. 21, 2004, now U.S. Pat. No. 7,267,754.

CONTRACTUAL ORIGIN OF INVENTION

The United States Government has rights in this invention pursuant to Contract No. W-31-109-ENG-38 between the U.S. Department of Energy and the University of Chicago, representing Argonne National Laboratory.

BACKGROUND OF THE INVENTION

1. Field of the Invention

This invention relates to an improved process and a device for the recovery of certain elements from used nuclear reactor fuels, and, more specifically, this invention relates to an improved process and a device to recover minor actinides and transuranic elements from spent nuclear fuel in an electrolytic salt bath.

2. Background of the Invention

Typical electrochemical processes to recover uranium from spent nuclear fuel result in the accumulation of minor actinides (americium (Am) and curium (Cu)) and transuranic elements (plutonium (Pu) and neptunium (Np)). These accumulated elements usually occur as metal chlorides in the molten electrolytic salt. They must periodically be removed from the electrolyte for the fuel reprocessing to continue.

The simplest method to recover the target elements is via chemical or electrochemical reduction. Electrochemical reduction has two advantages over chemical reduction. The first advantage is that the site of reduction is localized to the cathode surface forming a cathode deposit affording easy removal from the process equipment. The second advantage is that the use of electrons as the reducing agent does not add to the waste volume. Deposition of the transuranic elements and minor actinides on a solid cathode is well-known. Accompanying anode reactions include the oxidation of chloride ions to chlorine gas, oxidation of a sacrificial alloy, and oxidation of metallic uranium or reduced light water reactor (LWR) feed material.

Some electrorefiner pyroprocessing methods for MA's and, in particular, TRU's include the use of liquid cadmium (Cd) electrodes to reduce TRU's along with some uranium (U). FIG. 1 is a schematic diagram of the basic concepts of a cadmium electrode electrorefining system depicted as numeral 10. Chopped spent fuel 12 is placed in a ferric metal anode basket 14 which rests in an eutectic salt bath mixture of LiCl—KCl 16. Uranium and TRU's are anodically dissolved via oxidation with some uranium being reduced to metal 18 at a solid cathode 20. The remaining uranium and the TRU's are reduced and collected in/at a liquid cadmium cathode 22. The TRU's are stabilized in the liquid cadmium cathode 22 due to their low activity coefficients. Fission products such as alkali, alkaline earth and rare earth metals are dispersed within the salt bath 16. Noble metal fission products typically remain in the anode basket 14. Other electrorefining pyroprocessing methods for MAs and TRUs use ferric metals such as carbon steel as cathodes. Preferential deposition of MAs and TRUs over uranium at the cathode would eliminate many processing steps to separate the uranium from the MAs and TRUs.

U.S. Pat. No. 4,824,743 awarded to Fuji, et al. on Apr. 25, 1989 discloses an ion-exchange porous, secondary battery separation membrane.

U.S. Pat. No. 4,397,908 awarded to Philips on Aug. 9, 1983 discloses an electrically neutral non-permselective porous membrane which can transmit negatively and positively charged ions between electrodes.

None of the aforementioned patents disclose a method for the electrorefining of minor actinides and transuranics which uses only solid electrodes and has nonvolatile, noncorrosive products.

A need exists in the art for a method and device for more efficient, safer, and more facile electrorefining of minor actinides and transuranic elements. In addition, a need exists for a method and device which uses only solid electrodes and gives only nonvolatile, noncorrosive products.

SUMMARY OF INVENTION

An object of the present invention is to provide an improved process and device for the electrorefining of minor actinide and transuranic elements that overcomes many of the disadvantages of the prior art.

Another object of the present invention is to provide a process to remove minor actinide and transuranic chlorides from the molten electrolyte salt of spent nuclear fuel electrorefining. A feature of the invention is the use of a solid uranium oxidation anode. An advantage of this feature is the elimination of a need for an anode and materials that can withstand powerful oxidizing agents and the elimination of volatile moieties from the electrorefining process.

Still another object of the present invention is to provide a process that enables the use of a uranium oxidation anode. A feature of the invention is the isolation of anode reaction products (actinide chlorides) from the cathode. An advantage of this feature is that it slows the diffusion of uranium values to the cathode so the minor actinides and transuranic elements can be deposited at the cathode.

Yet another object of the present invention is to provide an electrolytic process that isolates anode reaction products from the cathode. A feature of the invention is the use of a porous membrane to separate the anodic and cathodic regions (the two half-cells) of an electrorefiner. An advantage of this feature is that it allows for the use of less expensive materials for the electrodes and accompanying electrolytic refiner structures.

Still another object of the present invention is to provide a process for minor actinide and transuranic electrorefining which produces an electrolyte salt that is relatively free of actinides and transuranic elements. A feature of the invention is that the metal salts in the electrolyte bath are depleted until their rate of reduction is limited by their diffusion from the anodic region to the cathodic region through a porous non-conducting membrane barrier. An advantage of this feature is that the salt can be readily passed on to waste disposal operations, without any pretreatment, for immediate handing of active metal and rare earth fission products, thus providing additional cost savings.

Yet another object of the invention is to provide a process which allows for co-deposition of transuranic elements over uranium. A feature of the invention is that as the cathode voltage is sufficiently negative that uranium and TRUs co-deposit at the cathode. An advantage of this feature is a proliferation-resistant removal (does not produce weapons-grade material) of transuranic elements.

Briefly, the invention provides a process for the improved electrorefining of minor actinides and transuranic elements, the process comprising supplying the actinides and transuranic elements in the form of spent nuclear fuel; placing the spent fuel in an anode basket; contacting an electrolyte containing actinides chlorides with the anode basket and a cathode; positioning a porous barrier between the anode basket and cathode so as to form an anolyte compartment and a catholyte compartment; and causing the concentrations of uranium, minor actinide (MA), and transuranic (TRU) ions in the catholyte compartment to decrease.

The invention also provides a device for the improved electrorefining of actinides and transuranic elements (TRU's) from a molten salt electrolyte, the device comprising a means for oxidizing the actinides and transuranic elements; a means for reducing the oxidized elements; and a means for controlling migration of the oxidized elements to the reducing means so as to selectively reduce the actinides.

BRIEF DESCRIPTION OF DRAWINGS

The invention together with the above and other objects and advantages will be best understood from the following detailed description of the preferred embodiment of the invention shown in the accompanying drawing, wherein.

DETAILED DESCRIPTION OF THE INVENTION

Figure 1:
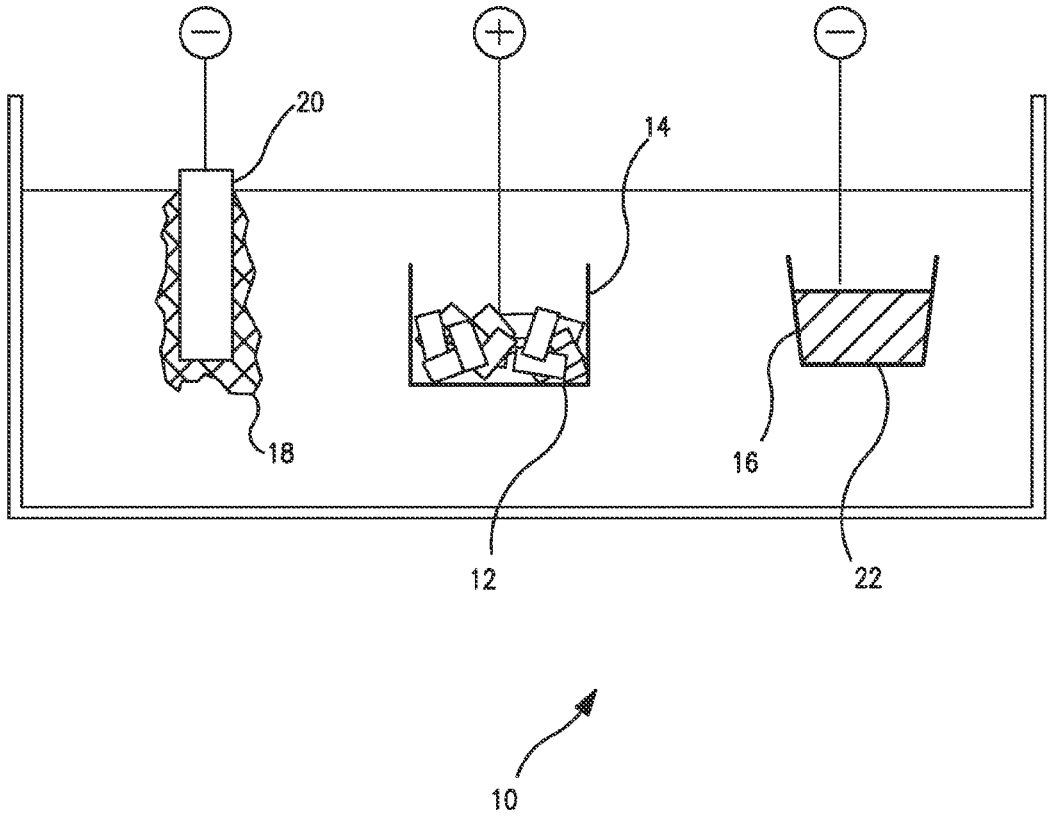
FIG. 1 PRIOR ART
FIG. 1 is a schematic of the basic features of electrorefining of transuranic elements using a cadmium electrode.

The instant invention provides an improved process and a device for the electrorefining of used nuclear fuels for the recovery of minor actinides and transuranic elements. In particular, this invention provides an improved process for the recovery of minor actinides and transuranic elements from a molten salt electrolyte by using a porous non-conducting membrane and solid electrodes in an electrochemical cell in a nuclear fuel electrorefiner. In addition, the invented process and device generates only nonvolatile, noncorrosive product streams at both electrodes.

As noted supra, typical electrolysis of actinide chlorides in spent nuclear fuel generates toxic chlorine gas. Oxidation of chloride ions to chlorine gas requires finding a suitable anode to withstand the chlorine as well as developing methods for collection of the evolved chlorine gas. Instead of a chlorine anode, this invention uses a uranium oxidation anode. Such use of a uranium oxidation anode requires isolating the anode reaction products, i.e., actinide (including uranium) chlorides, from the cathode. Otherwise, diffusion of uranium metal ions ($U^{3+}$) to the cathode would occur thereby stymieing preferential deposition of non-uranium actinides. This is because uranium is the most noble of the actinides. As such, uranium ion oxidizes any other actinide already deposited at the cathode and deposits itself at the cathode as uranium metal ($U^{0}$). This process continues until the uranium ion concentration is depleted in the cathode region.

The inventor has devised a method and device to limit the uranium ion concentration in the catholyte, thereby leading to the preferential non-uranium actinide deposition.

The inventors found that placing an electrically non-conducting porous barrier between the anode salt (anolyte) and the cathode salt (catholyte) in an electrorefiner induces the anodic oxidation of metallic uranium or reduced/used LWR feed material instead of the conventional anodic oxidation of chloride ion (Cr) to elemental or molecular chlorine ($Cl_2$). The oxidized uranium subsequently acts, in the form of $UCl_3$, as a key oxidizing agent in the catholyte. The $UCl_3$ results from the association of oxidized uranium ($U^{3+}$) with chloride ion already present in the electorefiner electrolyte bath infra. Other actinide chlorides, e.g., $PuCl_3$, similarly result from the oxidation of plutonium in the spent fuel and subsequent association with chloride ion in the melt.

A salient feature of the instant invention is the combination of a porous membrane and a uranium oxidation anode. This combination feature prevents the oxidation of chloride ions to chlorine gas and therefore eliminates the need for a chlorine-resistant anode or chlorine collection device.

Preferably, when using uranium oxidation anodes, the anode reaction products (i.e., actinide chlorides such as $PuCl_3$) are isolated from the cathode to slow the diffusion of the positively-charged uranium ions to the cathode. At the same time, the isolation of the cathode from uranium ion laden anolyte causes depletion of uranium ions (and other actinide or transuranic metal ions) within the catholyte, thereby inducing the oxidation of uranium and other actinide metals in the spent fuel within the anolyte.

The uranium oxidation anode comprises uranium metal in spent nuclear fuel which is contained within an anode basket. The anode basket typically comprises a ferric metal from the group consisting of, but not limited to, carbon steel, stainless steel, and other ferric alloys. The anode basket serves as an electrical lead or contact between the electrolyte melt and the uranium metal in the spent fuel.

While the anode comprises solid uranium metal, the cathode typically comprises a ferric metal such as a metal selected from the group consisting of, but not limited to, carbon steel, stainless steel, and other ferric alloys.

The molten electrolyte is comprised of a lithium chloride-potassium chloride (LiCl—KCl) eutectic mixture (LiCl:KCl=58.8:41.2 mol %), and uranium chloride ($UCl_3$, 4 to 7 wt. %). The molten electrolyte bath, in both the anode and cathode compartments, also contains transuranic chlorides and other fission products which come from spent nuclear fuel refining operations which remove only uranium. The operating temperature is above the LiCl—KCl eutectic melting-point temperature of ~360° C. Suitable operating temperatures are taken from approximately 400-600° C. Preferably, the operating temperature ranges from about 475° C. to 525° C., and most preferably at ~500° C.

Oxidation of metallic uranium and metallic minor actinides/transuranics takes place at the ferric metal anode baskets. The baskets have small holes to allow both migration of the actinide/transuranic ions produced by oxidation and more thorough contact between the anodes and the electrolyte melt. Subsequent reduction of these uranium and minor actinide/transuranic ions occurs at the cathode. Initially, when one actinide (including uranium) atom is oxidized at the anode, a uranium ion is reduced at the cathode within the cup. This maintains electro neutrality and allows the new actinide ion from the anode to associate with the needed three chloride ions. Generally, the process is depicted in Equations 1 and 2 wherein Equation 1 represents the anodic reaction and Equation 2, the cathodic reaction.

$$M(s) \rightarrow M^{3+}(I)+3e^- \quad \text{Equation 1 (Anode)}$$

$$M^{3+}(I)+3e^- \rightarrow M(s) \quad \text{Equation 2 (Cathode)}$$

M represents uranium along with several of the various isotopes of plutonium ($^{238}Pu$, $^{239}Pu$, $^{240}Pu$, $^{241}Pu$, $^{242}Pu$) americium ($^{241}Am$, $^{243}Am$), curium ($^{244}Cm$, $^{245}Cm$), and neptunium ($^{237}Np$). As was aforementioned, at the initiation of electrolysis, M in Equation 2 is uranium (U).

Initially, other actinides and transuranics such as plutonium are not reduced at the cathode, inasmuch as uranium is the most noble of the actinide metals and the most plentiful and reducible cation. Once an actinide other than uranium is reduced at the cathode, that actinide (e.g., Pu, Np, etc.) remains reduced in spite of the presence of $U^{3+}$ in the melt near the cathode. The continually-applied voltage which drives the reduction of the transuranic ions, keeps the transuranics reduced at the cathode.

When the uranium ion concentration in the catholyte is sufficiently depleted, the reactions within the catholyte are given by Equations 3 through 6.

$$Ac^{3+}(I)+3e^- \rightarrow Ac(s) \quad \text{Equation 3 (cathode deposition)}$$

$$Ac(s) \rightarrow Ac^{3+}(I)+3e^- \quad \text{Equation 4}$$

$$U^{3+}(I)+3e^- \rightarrow U(s) \quad \text{Equation 5 (cathode deposition)}$$

wherein Ac represents minor actinides/transuranics. The half-reactions represented by Equations 4 and 5 form a complete oxidation-reduction reaction which is represented in Equation 6.

$$Ac(s)+U^{3+}(I) \rightarrow Ac^{3+}(I)+U(s) \quad \text{Equation 6}$$

The anode resides outside the porous barrier or membrane, i.e., the barrier separates the anode compartment from the cathode compartment. The anode is essentially a porous basket (with holes) made of uranium. Current passes between the anode and the cathode at a voltage sufficient to electro deposit the transuranics on the cathode. As current continues to be passed between the cathode and the anode baskets, the flow of lithium ion ($Li^+$) and potassium ion ($K^+$) (from the anolyte salt bath) into the crucible is greater than the flow of $U^{+3}$ into the crucible. This is because to maintain electro neutrality within the crucible, each $U^{3+}$ (or any other actinide such as $Pu^{3+}$) which is reduced to neutral metal atoms in the cathode compartment must be replaced by three unit positive charges. That need is satisfied with transport of moieties embodying three positive charges, such as three potassium ions, three lithium ions, a combination of lithium and potassium ions migrating into the crucible for each actinide $3^+$ ion reduced, three chloride ions ($Cl^-$) migrating out of the crucible and into the anolyte, or a combination of the above. As such, the uranium and transuranics contained within the boundary of the porous crucible or membrane are removed from the molten salt by deposition at the cathode at a rate faster than they can be replenished by diffusion through the porous membrane or barrier.

As the uranium ion and transuranic element ion concentrations in the catholyte decrease, the current decreases. This decrease in current continues until the rate of uranium deposition on the cathode equals the rate of replenishment via diffusion through the porous membrane or barrier.

As the uranium concentration in the crucible/cup electrolyte salt decreases, the transuranics begin to co-deposit at the cathode. Eventually, the TRUs preferentially deposit. If the initial deposition voltage is set sufficiently high, some TRU deposition occurs from the very beginning of the "drawdown."

Equations 7 through 9 describe the diffusion behavior in the instant invention. Equation 7 gives the flux of actinide cations (as a current) across the porous barrier as a function of porosity, diffusion coefficient, barrier thickness, and anolyte concentration and catholyte concentration.

$$i=nFA_b\epsilon^{3/2}D_0(c_a-c_c)/L \quad \text{Equation 7}$$

The number of equivalents per mole is given by n (n=3 for most actinides for which the common and often only nonzero oxidation number is +3). F is Faraday's constant (96485 coulombs/equivalent), $A_b$ is the area of the porous barrier (typically in centimeters squared ($cm^2$)), $\epsilon$ is the porosity of the barrier (dimensionless values only between 0 and 1), L is the thickness of the porous barrier (typically in centimeters (cm)), $D_0$ is the diffusion coefficient ($cm^2$ per second ($cm^2$/sec)) of the actinide cation, $c_a$ and $c_c$ are the concentrations of the actinide chlorides in the anolyte and catholyte, respectively. The porosity, $\epsilon$, can range from 1 (wide-open) to 0 (blocked or completely non-porous).

At the cathode, the current due to electro deposition of uranium, transuranics, and minor actinides at the cathode surface will be limited by diffusion of these moieties to the cathode surface. As the moieties concentrations in the catholyte decreases, the current decreases. Eventually, the rate of deposition on the cathode surface equals the rate of "seepage" of uranium, MA's, and TRU's into the catholyte for subsequent reduction. Thus, a steady-state condition is attained.

The concentrations of uranium, MA's and TRU's cannot be decreased any further than this steady-state concentration. Equation 8 describes the diffusion-limited current at the cathode surface.

$$i=nFA_cD_0c_c/\delta \quad \text{Equation 8}$$

In Equation 8, $A_c$ is the cathode surface area, $\delta$ is the thickness of the Nernst diffusion layer at the cathode surface (~$10^{-2}$ centimeter (cm)), and n, F, $D_0$, $c_c$; all have the same meanings as in Equation 7.

Actual current levels depend upon the scale of the equipment and the porosity of the barrier. At the steady-state condition, Equation 7 equals Equation 8 and can be solved for the concentration of actinide ions (including uranium ion) in the catholyte, $c_c$, which is given in Equation 9.

$$c_c=A_b\epsilon^{3/2}c_a/[A_b\epsilon^{3/2}+LA_c/\delta] \quad \text{Equation 9}$$

All variables in Equation 9 are as defined supra.

Figure 2:
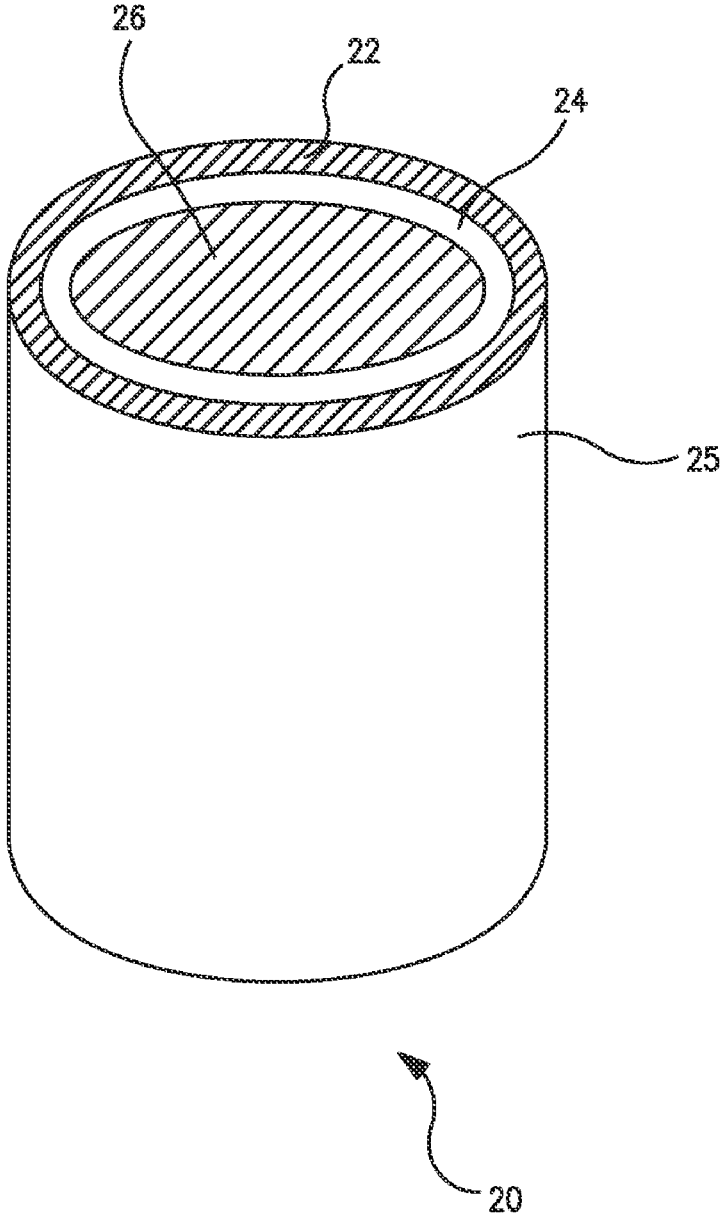
FIG. 2 is a schematic diagram of the device, in accordance with features of the present invention.

An electrically non-conducting porous barrier encapsulating an electrode cup is depicted in FIG. 2 as numeral 20. The actual barrier 22 isolates the outer surface 25 of the cup 24 from physical contact with anolyte. Electrolyte is placed in the interior 26 space defined by an interior surface of the cup 24.

The porous barrier 22 allows uranium (and other actinides/transuranics) to migrate between the anode salt and the cathode salt, but causes the migration to be slower than it would be without the porous barrier 22. Thus, this migration route causes the uranium ion concentration in the cathode salt (catholyte) to decrease more rapidly than the concentration would have without the presence of the barrier. The route also causes the other actinide ion concentrations to decrease too, thus cleansing the catholyte salt for further processing.

An increase in the thickness of the porous barrier 22 further decreases the uranium ion concentration in the catholyte by making the diffusion process slower. A decrease in the porosity of the barrier can also slow the diffusion process. Both factors, greater thickness and lesser porosity, lower the steady-state concentrations of uranium and the minor actinides/transuranics. This facilitates the deposition of the minor actinides/transuranic elements over the deposition of uranium at the cathode. The minor actinides/transuranics are more active metals than uranium and are oxidized by uranium ion. A lowering of the uranium ion concentration within the catholyte enhances minor actinide/transuranic deposition at the cathode.

The porous barrier 22 can be made from any material which does not react significantly with the uranium and plutonium in the salt. Further, the material must remain intact and porous. Suitable material is selected from the group consisting of aluminum (Al) felt, aluminum nitride (AlN), and beryllium oxide (BeO). Other nonreactive insulating materials can suffice for the porous barrier.

The cup 24 is made from porous insulator materials. Suitable materials include those selected from the group consisting of aluminum nitride (AlN), alumina ($Al_2O_3$), and porous alumina.

The voltage applied (a negative voltage) between the anode and cathode ranges from of about 0.8 volt (V) to 1.5 V.

The porous membrane/barrier 22 and cup 24 in place in an electrorefiner and the electrolysis process of the instant invention are depicted in FIGS. 3A-E as numeral 30. As was done in the example infra, the membrane/barrier material, if flexible, can be wrapped around the cup and held in place around/on the cup, e.g, clamps, etc. Compression of the membrane/barrier material can make it less porous. Tightness of the material around/on the cup is not needed so long as the anolyte-exposed surfaces of the cup, including the bottom of the cup, is encircled or encased by the material. (See FIG. 4 wherein the outwardly facing surfaces of the cup is shielded from unhindered contact by anolyte.) Complete encasement by the barrier substrate will suffice.

Figure 3A:
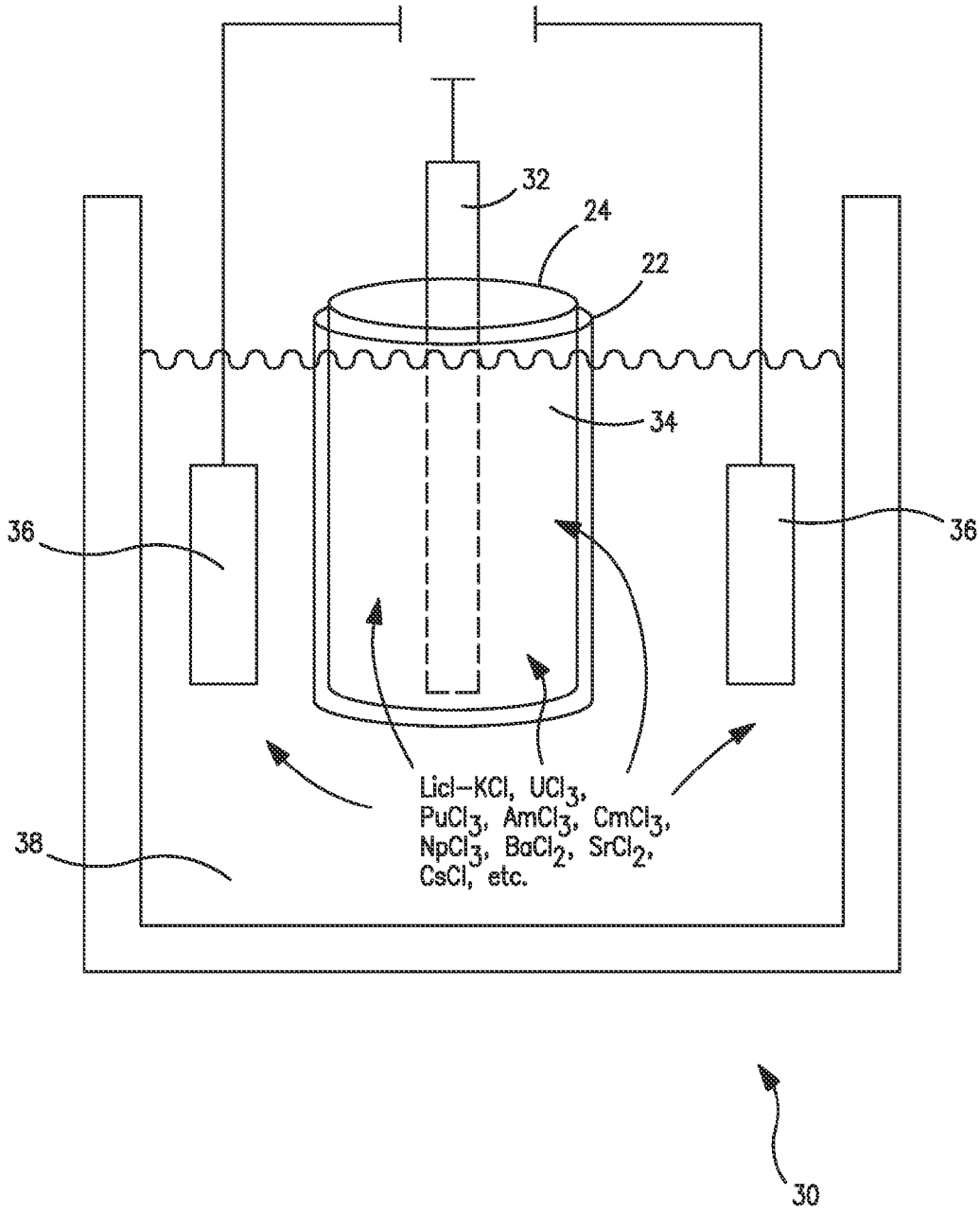
FIGS. 3A-E is a schematic diagram of an electrorefiner cell, device, and steps of the invented process, in accordance with features of the present invention.
Figure 3B:
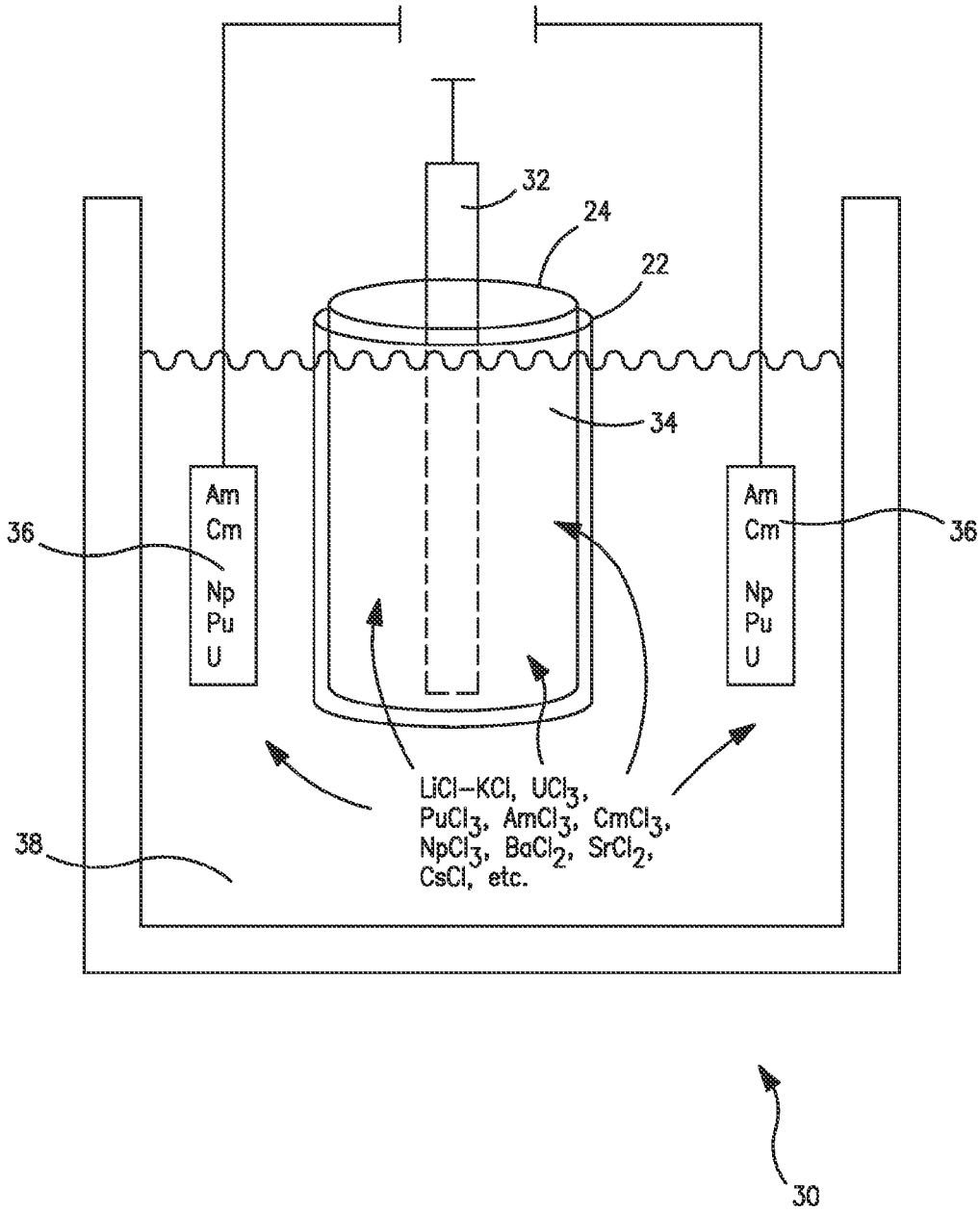

In FIG. 3A, the cathode 32 rests within the catholyte 34 which is within the cup 24. Two anode baskets 36 are shown. The anodes 36 and the cup 24 rest within the anolyte 38. The anolyte 38 and catholyte 34 initially are the same and comprise a melt of KCl—LiCl with approximately from about 5 wt. % to 7 wt. % $UCl_3$, and chlorides of fission products (e.g., $BaCl_2$) and of transuranic elements (e.g., $PuCl_3$) from other electrolysis systems used to remove uranium. In FIG. 3A, before the initiation of electrolysis, the KCl, LiCl, and all other salt components including the chlorides of fission products and the chlorides of all the actinides (Am, Cm, Np, Pu, and U) migrate freely and at random within both the anolyte 38 and the catholyte 34. FIG. 3B depicts the electrorefiner with the diverse actinides added to the uranium anode baskets 36 as waste metal originating from spent nuclear fuel such as LWR fuel.

Figure 3C:
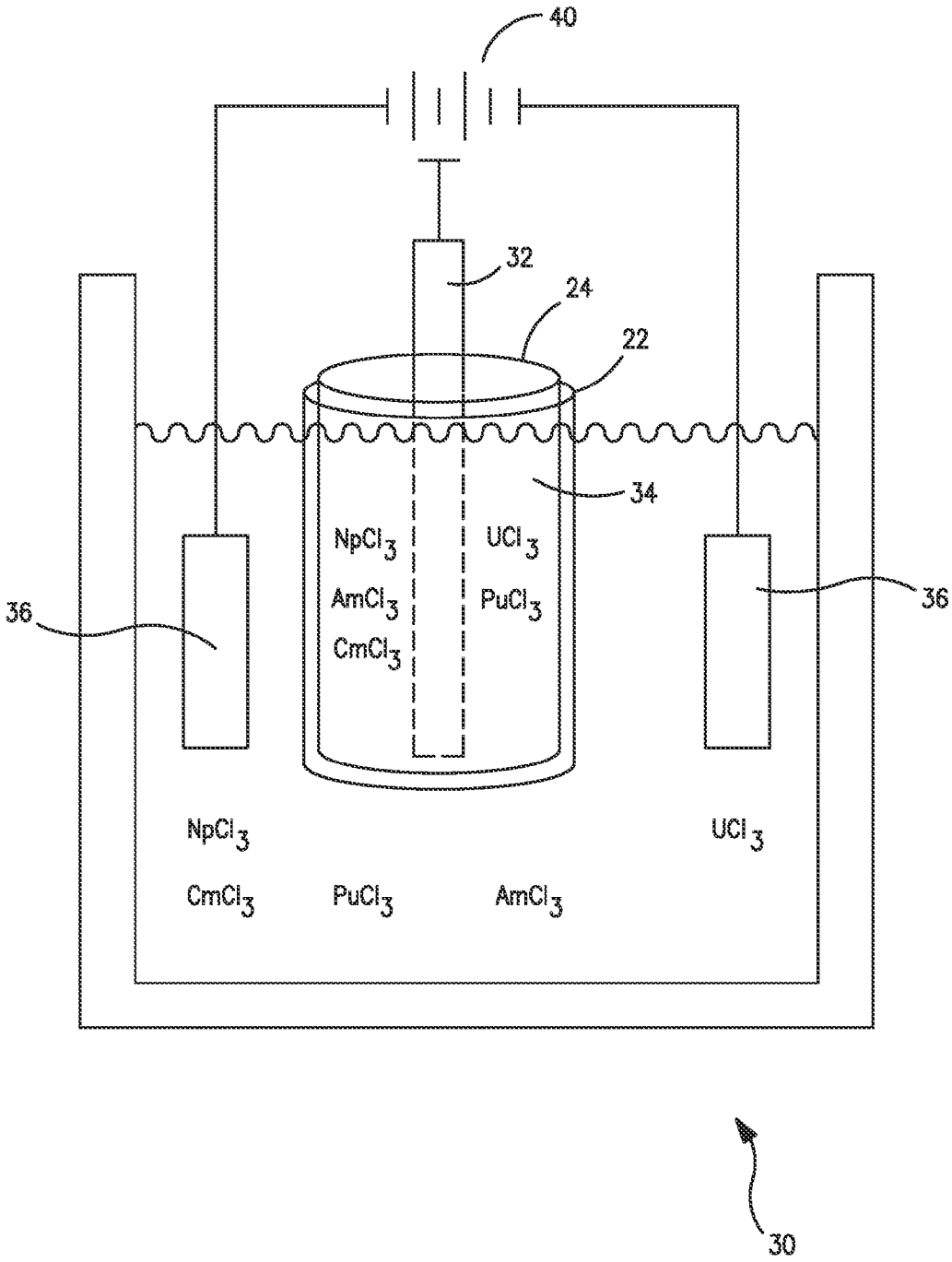
Figure 3D:
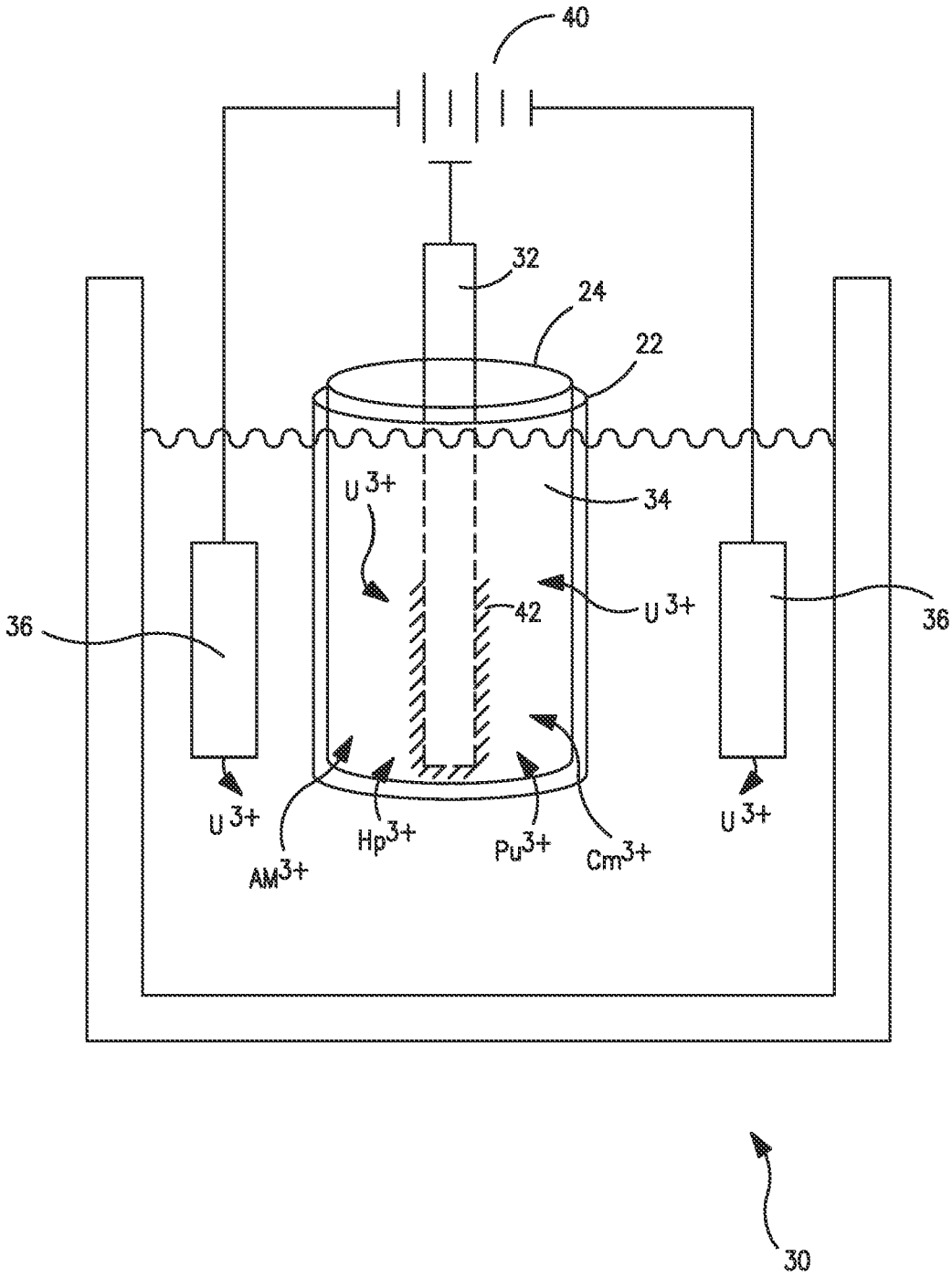
Figure 3E:
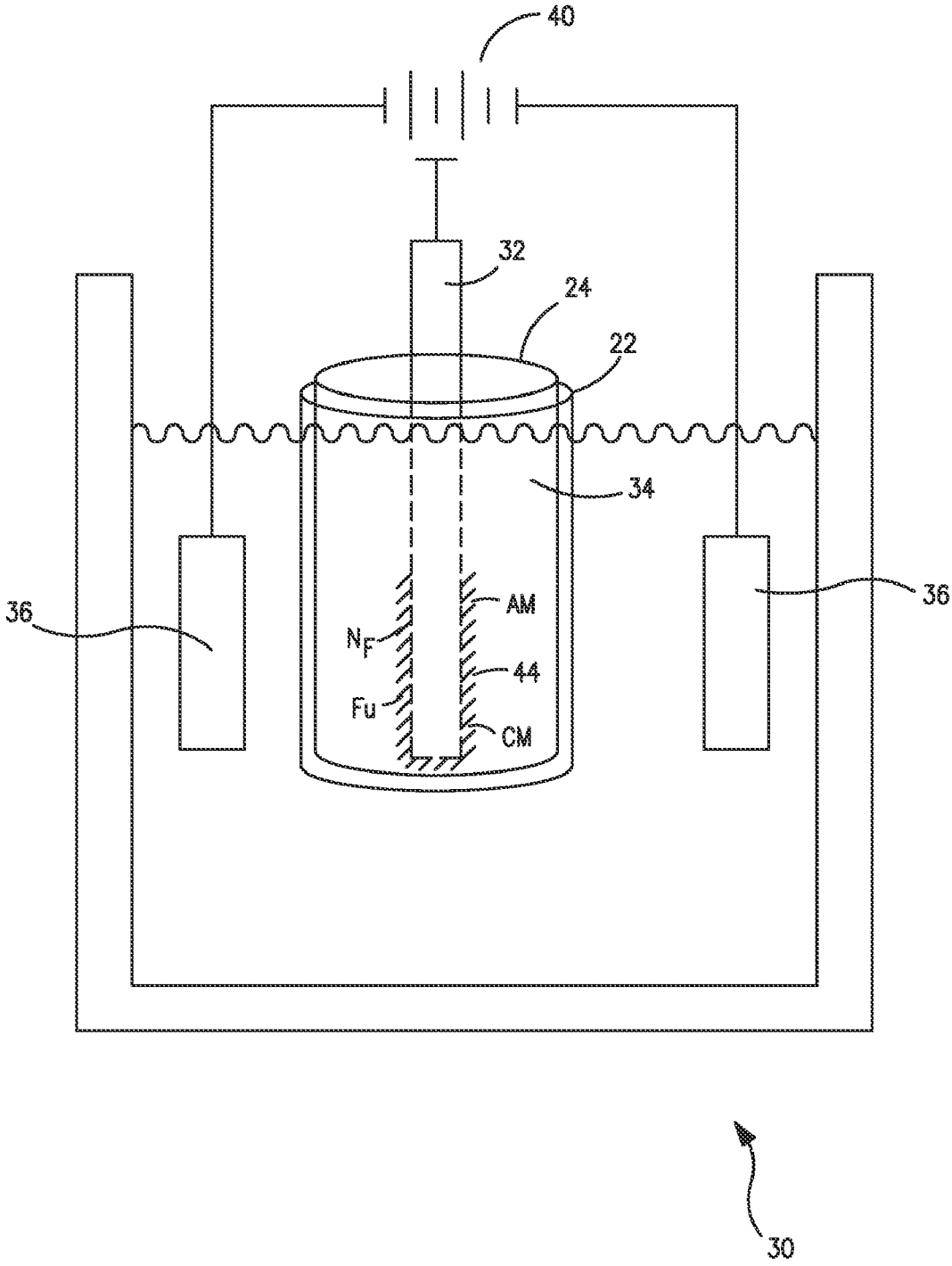

FIG. 3C depicts the electrorefiner and a power supply 40 in actual operation (electrical flow commenced) with the actinides now oxidized to $3^+$ ions and associated with chloride ($Cl^-$) ions. FIG. 3D depicts the electrorefiner with the actinide ions migrating, uranium metal 42 being deposited at the cathode, and the production of $U^{3+}$ via the oxidation of the uranium in the anode baskets 36. During the entire process there is a net flow of cations into the crucible and a net flow of anions ($Cl^-$) out of the crucible. FIG. 3E depicts the eventual preferential deposition of the transuranics (Am, Cm, Np, Pu) 44 which occurs after the depletion of the uranium ion concentration within the catholyte.

Figure 4:
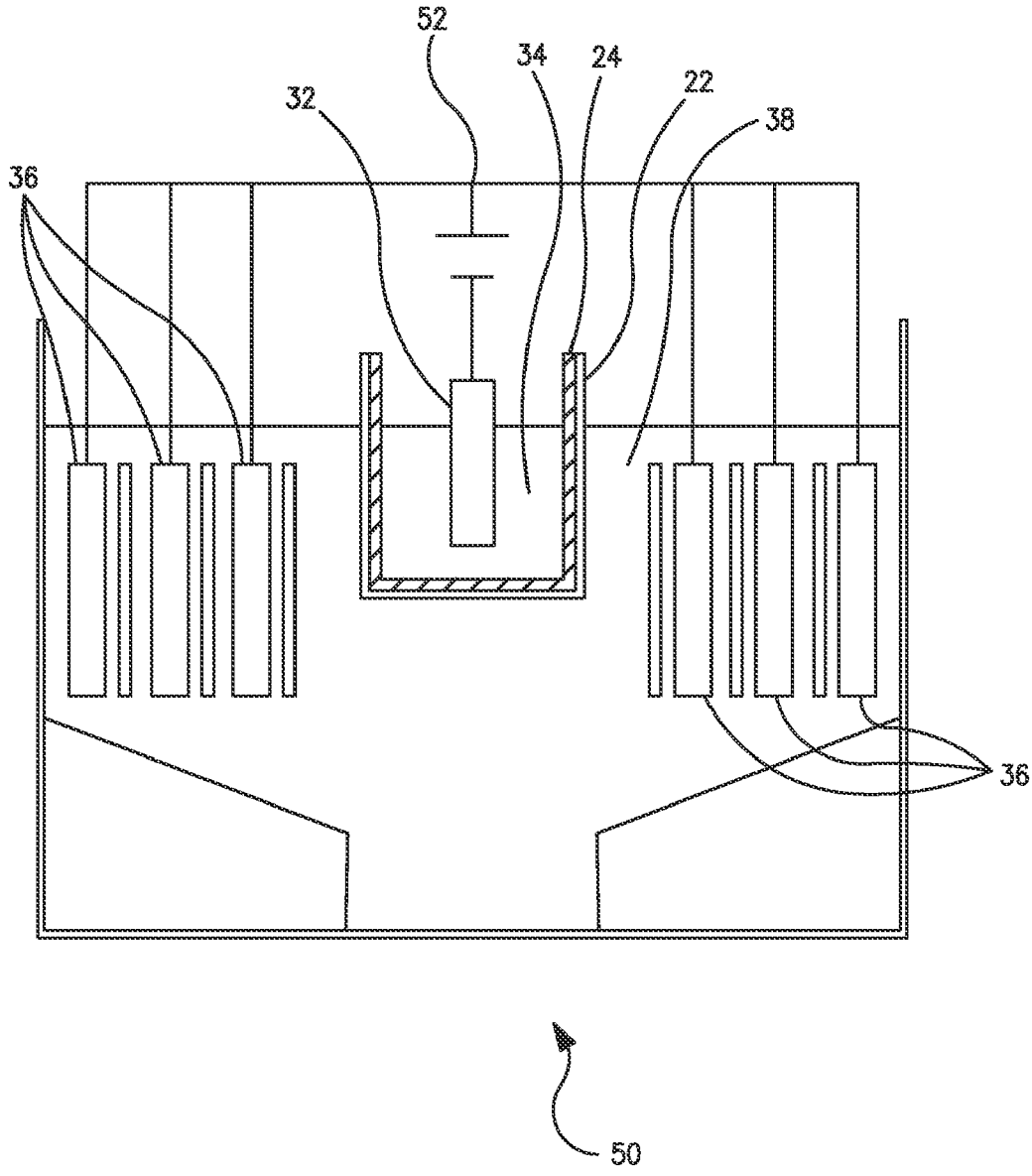
FIG. 4 is a schematic diagram of the device in place in a multi-anode electrorefiner, in accordance with features of the present invention.

A larger and more complex electorefiner is depicted in FIG. 4 as numeral 50. The cathode 32 and a number of anode baskets 36 are placed in the catholyte 34 and anolyte 38 electrolyte salt baths, respectively. A power source 52 supplies the voltage and current.

The invention also exploits the phenomenon that the more negative the potential of a reaction, the less spontaneous the reaction. Specifically, a voltage or decomposition voltage (−0.8 V) of the cell is less negative (a lower absolute value) than a voltage of (−1.6).

Applied voltages can be controlled at a level so as to not oxidize other metals present in, for example, the electrorefiner. An example of the non-oxidation of other metals present in the electrorefiner is that of iron (Fe) (e.g., anode baskets and cathode). The reaction by which iron (Fe) is oxidized at the anode and uranium (U) is deposited at the cathode is given in Equation 10.

$$3Fe(s)+UCl_3(l)\rightarrow 3FeCl_2(l)+U(s) \qquad \text{Equation 10}$$

The standard potential for this reaction at 500° C. is −1.13 V. Thus, cell voltages greater than approximately −1 V can result in some corrosion of the iron anode baskets. If more negative cell voltages (e.g. −1.2 V) are required to drive the electrolysis, a more noble (less reactive) metal can be used for constructing the anode baskets.

The following example is only to illustrate the application of the instant invention and does not exclude the use of materials and conditions other than those mentioned infra.

Example

Four slots were cut into an aluminum nitride crucible so that the slots extend parallel to the longitudinal axis of the crucible. The slots serve as a means to facilitate fluid communication between the annular space (defined by an exterior surface 25 of the crucible and the barrier) and the interior 26 of the crucible. One layer of porous alumina felt (>90% porous) was wrapped around an aluminum nitride crucible. The wrapped crucible was placed in a larger steel container containing molten LiCl—KCl typically with from approximately 5 wt. % to 7 wt. % $UCl_3$. (The solubility limit of $UCl_3$ in the melt is 50 wt. %). A cathode was placed inside the wrapped crucible and some metallic uranium was added to the salt in the outer steel crucible, which also served as the anode. When a constant voltage (~1 volt (V)) was applied between the cathode and anode, the current decayed as time progressed. A sample of the salt from the cathode region of the cell, taken after the current had decayed to a lower and constant value, was noticeably lighter in color (purple) than the original salt. This color change serves as a means to indicate deletion of uranium ion within the catholyte. Analysis, via alpha counting, of the salt samples from the anode and cathode regions showed a decrease in uranium concentration in the cathode region. See Table 1 infra.

The test was repeated with an additional three layers of alumina felt wrapped around the crucible and a similar decrease in uranium concentration was observed in the cathode region. The results for this test are also given in Table 1.

TABLE 1

Analysis of uranium content of cathode and anode compartments of porous membrane cell for U/TRU recovery.

| No. of layers of alumina felt | U concentration in cathode salt (dpm/g)[a] | U concentration in anode salt (dpm/g)[a] | % reduction |
|---|---|---|---|
| 1 | 9028 | 13043 | 30% |
| 3 | 4800 | 30250 | 84% |

[a]dpm/g = disintegrations per minute per gram of salt.

The use of even more layers of alumina felt will reduce further the diffusion rate of uranium ion into the catholyte, and make the uranium ion concentration therein still lower. A similar effect will be accomplished by using metal felt of a lesser porosity.

A test was also conducted with 7 wt. % of $UCl_3$ in a LiCl—KCl electrolyte. At the end of the run, the salt inside the crucible/cup had an $UCl_3$ concentration of less than 1 wt. %.

In summary, the instant invention provides an improved means for the electrorefining of minor actinide and transuranic elements.

Salient features of the invention are the use of a porous nonconducting barrier which separates the anodic and cathodic regions of an electrorefiner, and the use of only solid electrodes, in particular a solid uranium anode.

The porous barrier allows uranium ions to migrate between the anode salt and the cathode salt.

The porous barrier lowers the uranium ion and transuranic (TRU) ion concentrations in the cathode salt (catholyte).

Increased layers of membranes, thicker membranes, and lower membrane porosities lower even more the uranium and TRU ion concentrations in the catholyte via a lowering of the diffusion rate of uranium ion into the catholyte.

The lowering of uranium and TRU ion diffusion into the catholyte allows for the reduction and deposition of minor actinide/transuranic metals.

Thus, the instant invention is suitable for the improved isolation and extraction of uranium (U) minor actinide (MA) and transuranic (TRU) metal values.

The instant invention allows for the use of an uranium oxidation anode via the isolation of the anode reaction products, i.e., actinide chlorides from the cathode to slow diffusion of uranium values to the cathode. The uranium oxidation anode gives only nonvolatile, non-corrosive products. The invention exploits the phenome-non that the thicker the porous membrane/barrier, the lower the steady-state concentrations.

While the invention has been described with reference to details of the illustrated embodiment, these details are not intended to limit the scope of the invention as defined in the appended claims.

I claim:

1. A device for the improved electrorefining of actinides and transuranic elements from a molten salt electrolyte containing at least one element from the actinide series, the device comprising:

an external container of specified cross-sectional area and volume, said external container of holding a quantity of said molten salt electrolyte containing at least one element from the actinide series;

a first porous container of smaller cross-sectional area than said external container where said first porous container is partially submerged in said molten salt electrolyte that is held within said external container;

a second porous container of smaller cross-sectional area than said first porous container where said second porous container is nested in said first porous container, said second porous container holding a quantity of said molten salt electrolyte containing at least one element from the actinide series;

a cathode which is positioned interior to said second porous container where said cathode is submerged in said molten salt electrolyte that is held within said second porous container and where said cathode has an electrical contact attached at a given position on said cathode;

a series of one or more anodes positioned exterior to said first porous container and interior to said external container where said anode/anodes are submerged in said molten salt electrolyte that is held within said external container and have electrical contacts positioned at selected sites on said anode/anodes.

2. The device as recited in claim 1 wherein the first porous container is made of a material selected from the group consisting of aluminum felt, porous aluminum nitride, and porous beryllium oxide BeO.

3. The device as recited in claim 1 wherein the anode/anodes are fabricated of solid uranium metal.

4. The device as recited in claim 3 wherein an increase in the thickness of the first porous container effects a uranium ion concentration in the molten salt electrolyte contained in the second porous container.

5. The process device as recited in claim 3 wherein a decrease in the porosity of the first porous container effects a uranium ion concentration in the molten salt electrolyte contained in the second porous container.

6. The device as recited in claim 1 wherein the molten salt electrolyte contains uranium and a selection of respective container porosity allows the uranium to migrate between an anolyte which is the molten salt electrolyte exterior to said first porous container and interior to said external container and a catholyte which is the molten salt electrolyte interior to said second porous container.

7. The device as recited in claim 6 wherein the second porous container is made of a material selected from the group consisting of aluminum nitrate (AlN) and alumina ($Al_2O_3$).

8. The device as recited in claim 1 further comprising a selected power source which couples the terminals of the cathode and anode.

* * * * *